US006952911B2

(12) United States Patent
Byrd, Jr. et al.

(10) Patent No.: US 6,952,911 B2
(45) Date of Patent: Oct. 11, 2005

(54) AUTOMATIC CASE PACKAGING SYSTEM

(75) Inventors: Charles Dale Byrd, Jr., West Monroe, LA (US); Mark P. Rasmussen, Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/401,908

(22) Filed: Mar. 28, 2003

(65) Prior Publication Data

US 2004/0187447 A1 Sep. 30, 2004

(51) Int. Cl.[7] ..... B65B 35/50

(52) U.S. Cl. ..... 53/535; 53/540; 53/247; 53/387.1; 271/214

(58) Field of Search ..... 53/247, 540–542, 53/535, 531, 503, 504, 387.1; 271/214

(56) References Cited

U.S. PATENT DOCUMENTS 2,941,339 A * 6/1960 Salwasser ..... 53/541
4,161,092 A * 7/1979 Buday et al. ..... 53/244
4,332,124 A * 6/1982 Jaton ..... 53/540
4,707,970 A * 11/1987 Labombarde et al. ..... 53/542
5,588,285 A * 12/1996 Odenthal ..... 53/542

* cited by examiner

*Primary Examiner*—Stephen F. Gerrity
(74) *Attorney, Agent, or Firm*—Womble Carlyle Sandridge & Rice, PLLC

(57) ABSTRACT

An automatic case packaging system having a conveyor and stacking assembly, a servo-powered elevator and a case positioning assembly. The conveyor and stacking assembly is provided to receive a plurality of articles and to form a stack of the articles. The conveyor has a flat, receiving portion and an arcuate portion that feeds the articles to the top of an incline where they are collated into a stack for loading. The case positioning assembly is located adjacent the servo-powered elevator and is provided to receive a case in a receiving position, to move the case to a loading position wherein an open end of the case is located adjacent the stack of articles that has been lowered on the elevator. An air-powered ram is provided to push the stack of articles into the open end of the case. When the stack is lowered to the case height, side guides open to guide the cartons into the case to prevent the cartons from hanging on the edge of the case. The case is then reoriented on the tilt rack to a vertical position and conveyed away from the elevator. A full case clamp is used to clamp the full case when it rotates to the discharge position.

20 Claims, 11 Drawing Sheets

AUTOMATIC CASE PACKAGING SYSTEM

BACKGROUND OF THE INVENTION

The present invention is generally related to case packaging apparatus or machines, and more specifically, to automatic case packaging systems for flat articles.

Case packaging machines are often used to pack articles into cases. Such case packaging machines include a stacking assembly to form a stack of the articles, a case positioning assembly to position an open end of a case adjacent the stack of articles, and a pusher assembly to push the stack of articles into the open case. Such case packaging machines are typically employed in conjunction with other automated machines that are used to form the case from a flat blank, deliver the formed case to the case packaging machine, and then close and seal the case after it has been loaded. Generally, the case packaging machine receives a case in a first or receiving position and moves it to a second or loading position, where the case then receives the stack of articles. After the case is loaded, it is either returned to the receiving position or moved to another position from where the case is removed for further handling.

SUMMARY OF THE INVENTION

The present invention is an automatic case packaging system that includes a conveyor and stacking assembly, a servo-powered elevator and a case positioning assembly. The conveyor and stacking assembly is provided to receive a plurality of articles and to form a stack of the articles. The conveyor and stacking assembly includes a conveyor having a flat, receiving portion and an arcuate portion that feeds the articles to the top of an incline where they are collated into a stack for loading. The case positioning assembly is located adjacent the servo-powered elevator and is provided to receive a case in a receiving position, to move the case to a loading position wherein an open end of the case is located adjacent the stack of articles formed by the stacking assembly and lowered to the loading position by the elevator. An air-powered ram located adjacent to the elevator in its lowered position is provided to push the stack of articles into the open end of the case.

The automatic case packaging system of the present invention automatically collates and loads packing cartons into boxes (i.e., cases) for packaging and shipment. The case packaging system receives a plurality of flat cartons at a first-end. The cartons are then fed over an arcuate (i.e., curved) conveyor and under an overhead roller that includes a counter. The counter counts a predetermined number of cartons, which are then fed to a servo-powered elevator. A surge gate catches the stack of cartons and moves to become a guide for the stack when the stack loads on the elevator. The servo-powered elevator has an adjustably positioned bottom plate that lowers as cartons are stacked thereon. The servomotor uses a timing belt to raise and lower the elevator. A case is moved into position adjacent the elevator and tilted on a tilt rack to a horizontal position. Once a stack is completed on the elevator, a ram pushes the stack of cartons into the horizontally positioned case. When the stack is lowered to the case height, side guides open to guide the cartons into the case to prevent the cartons from hanging on the edge of the case. The case is then reoriented on the tilt rack to a vertical position and conveyed away from the elevator. A full case clamp is used to clamp the full case when it rotates to the discharge position.

DETAILED DESCRIPTION OF THE INVENTION

The following description of the invention is provided as an enabling teaching of the invention in its best, currently known embodiment. Those skilled in the relevant art will recognize that many changes can be made to the embodiments described while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

Figure 1:
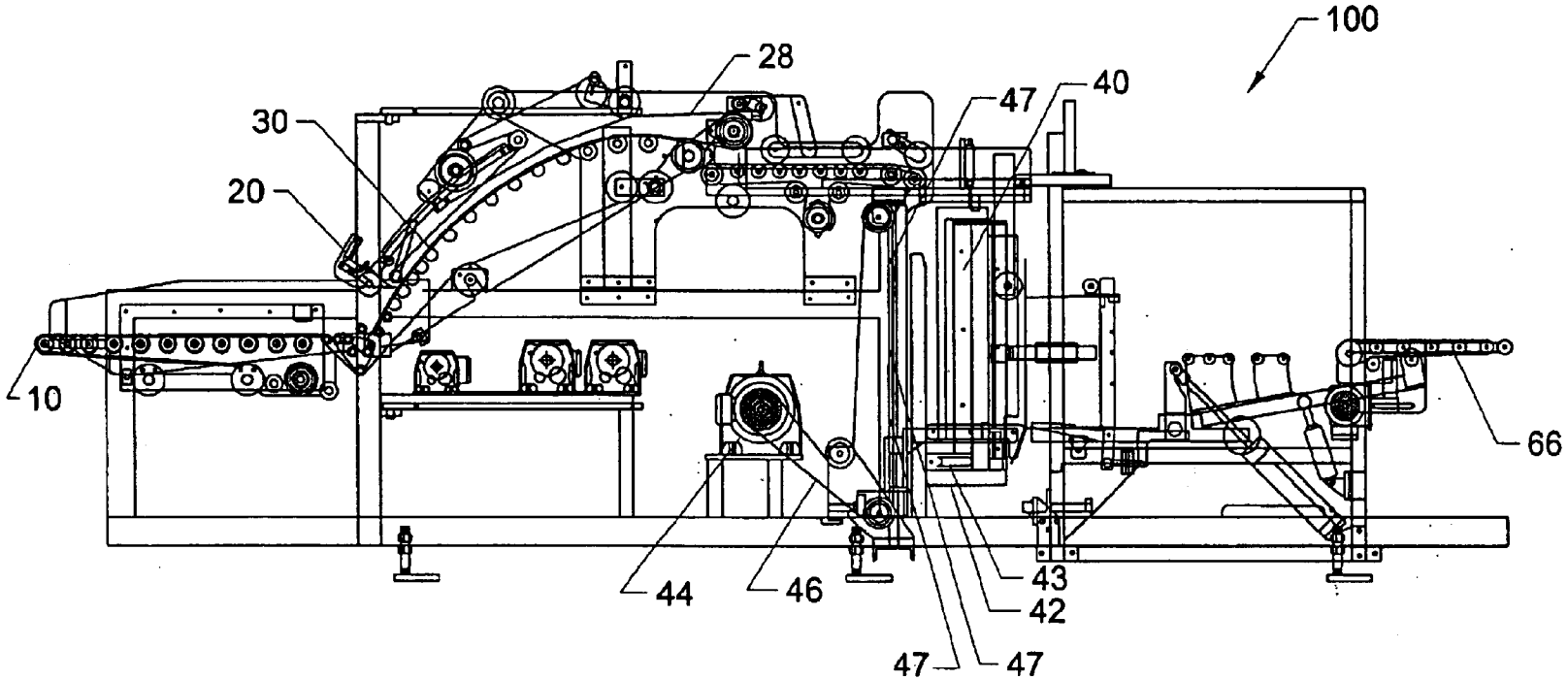
FIG. 1 illustrates an elevation side view of an automatic case packaging machine.

FIG. 1 illustrates an elevation side view of the automatic case packaging machine 100. Cartons are loaded on a flat portion 10 of the in-feed conveyor system. The cartons slide under the stacker guide 20 which houses a linear potentiometer that controls the speed of the in-feed. In an alternative embodiment, an ultrasonic in-feed control mechanism can be used. The cartons are conveyed over arcuate conveyor 30 with an electric eye at the top of the conveyor counting a desired number of cartons to load into a case. In an exemplary embodiment, a 1.5 inch incline belt 28 is used for better control of the cartons on the arcuate conveyor 30. Servo-powered elevator 40 includes an adjustable bottom plate 42. Surge gates 36 close off the stack and move to become a guide for the stack as the elevator 40 loads. The case rack lowers to orient the cartons for filling the case.

Figure 2:
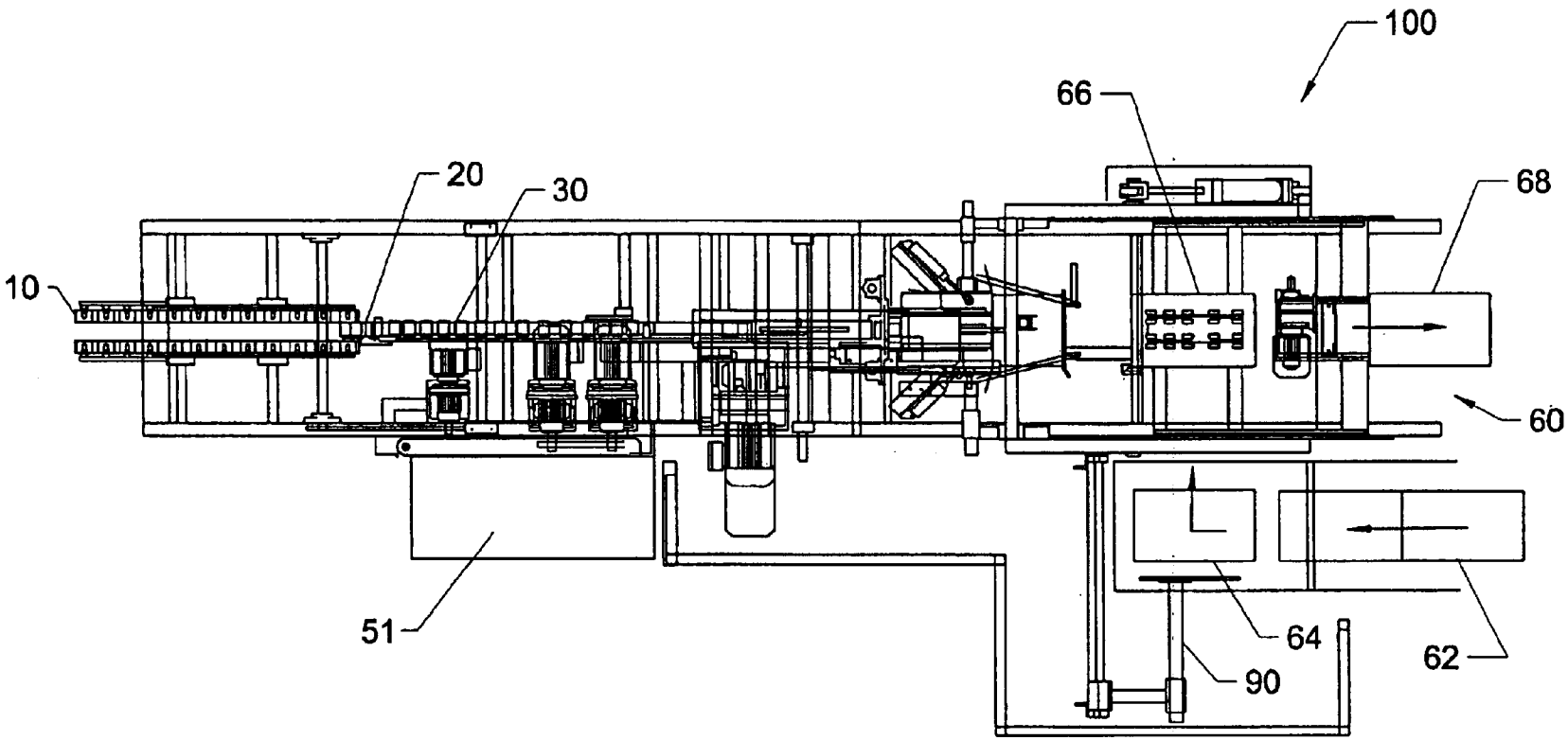
FIG. 2 illustrates a plan view of the automatic case packaging machine of FIG. 1.
Figure 7:
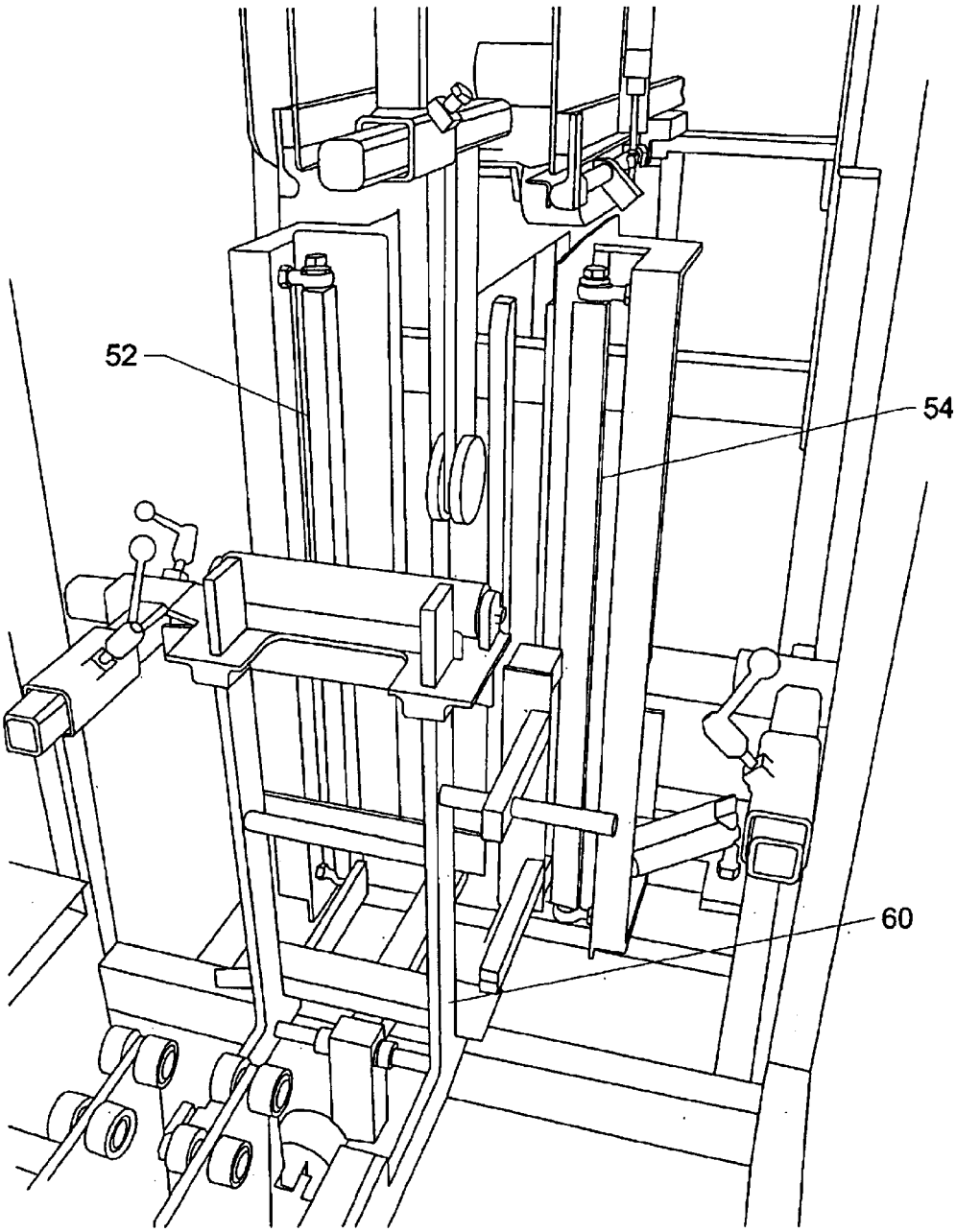
FIG. 7 illustrates a perspective view of a portion of the automatic case packaging machine of FIG. 3.
Figure 10:
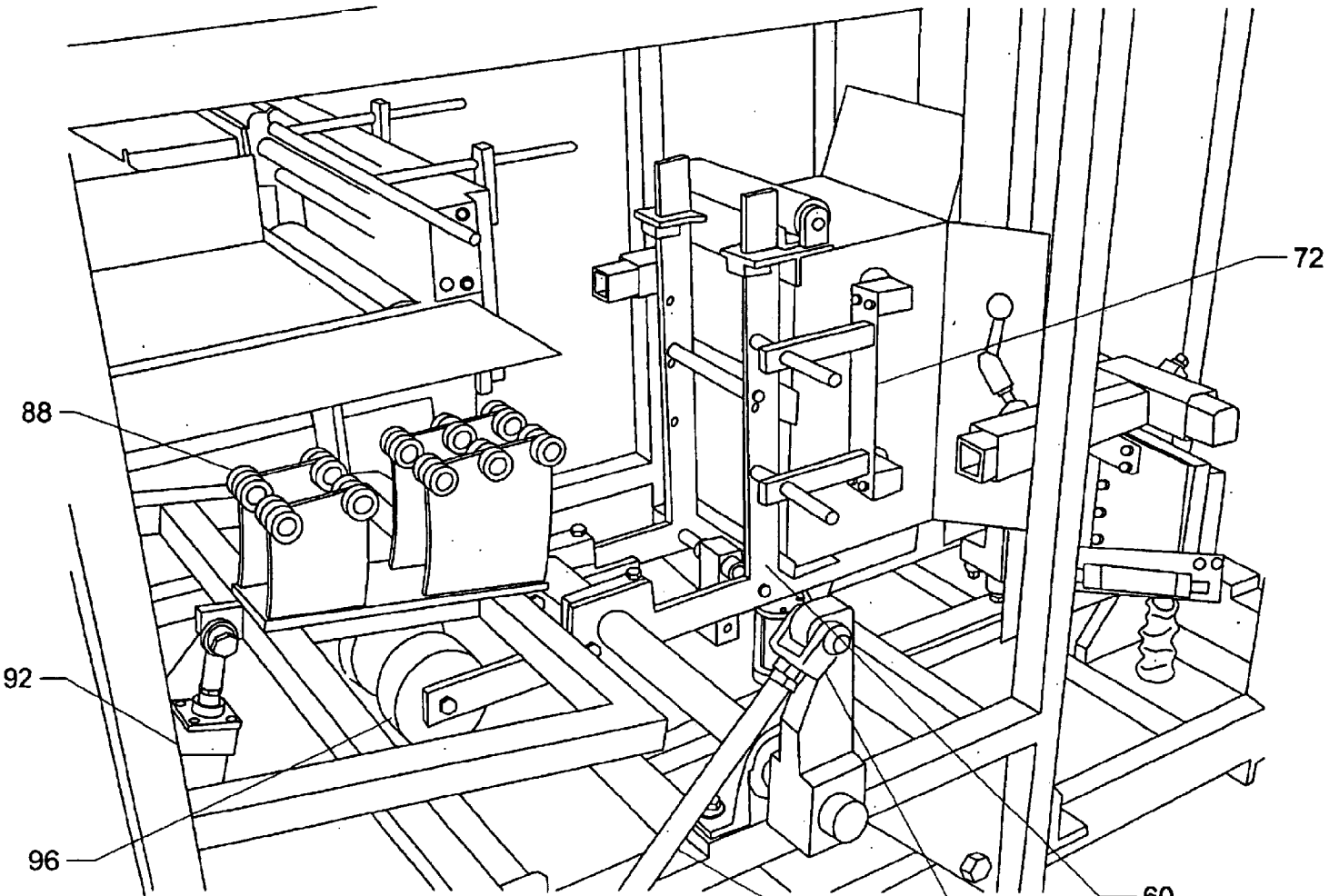
FIG. 10 illustrates a further perspective view of a portion of the automatic case packaging machine of FIG. 3.
Figure 11:
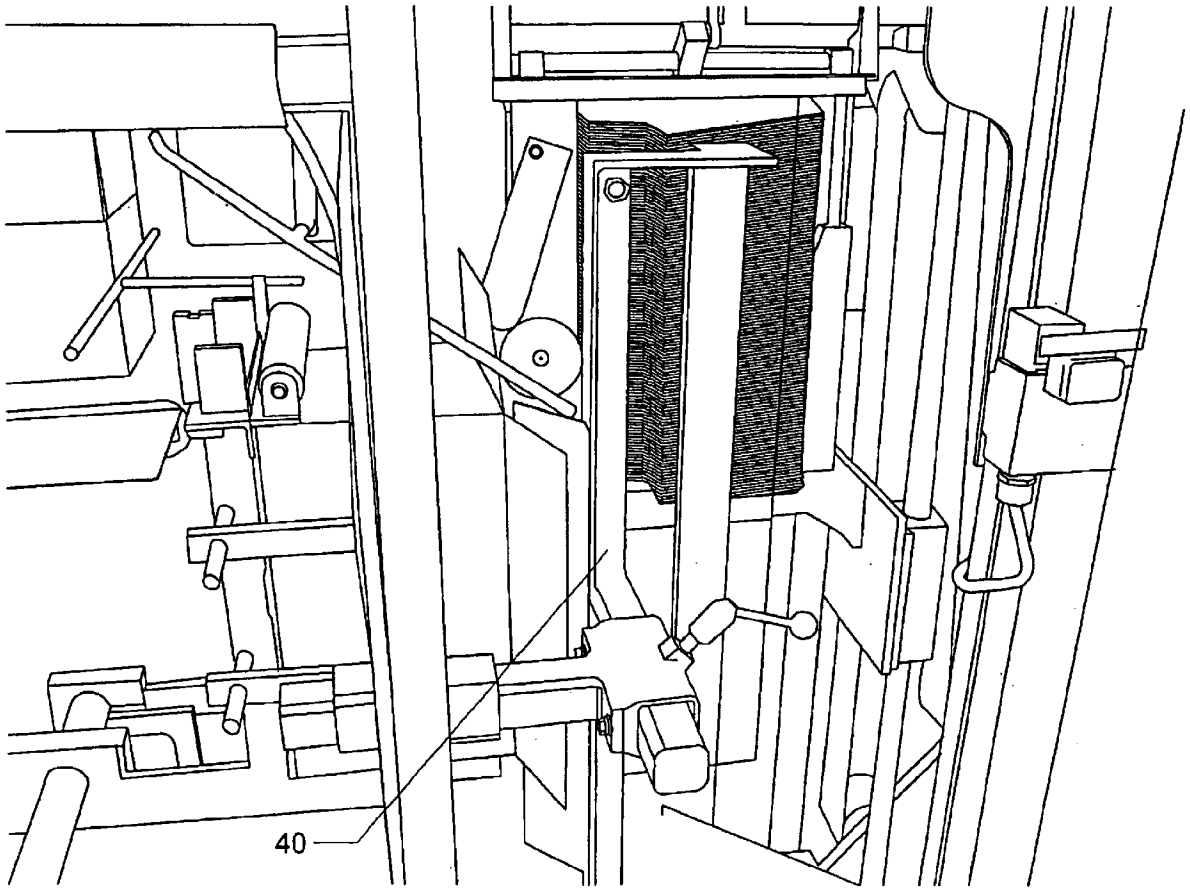
FIG. 11 illustrates another perspective view of a portion of the automatic case packaging machine of FIG. 3.

FIG. 2 illustrates a top plan view of the automatic case packaging machine 100. This view shows the case positioning system mechanism 60. Cases are loaded on the case positioning mechanism at position 62 and are conveyed to position 64. Ram 90 pushes the case into the load position onto case rack mechanism 66 where the case is tilted into position to receive the cartons from elevator 40. The filled cartons are then pushed off the case positioning mechanism at position 68. The case positioner mechanism 60 of the invention in a "load configuration" without a case and adjacent to elevator 40 is depicted in FIG. 7. The case positioner mechanism 60 in a "load configuration" with a case is shown in FIG. 10. Clamping mechanism 72 keeps the case in place as it is filled with cartons, and is then rotated to a discharge position.

The automatic case packaging system of the present invention is the only such auto packer to use servomotors and timing belts to run the auto packer. All other case packaging apparatus use hydraulic systems. Referring again to FIGS. 1 and 2, three motors are used in an exemplary embodiment of the present invention. A first motor 44 uses a timing belt 46 to raise and lower the elevator. The other two motors run the in feed and out feed belts. This enables the elevator to be adjustable in travel up and down. The elevator is controlled by a set of "photo eyes" 47 wired into a programmable logic controller (PLC) 51. No other auto packer can be adjusted for travel.

Figure 3:
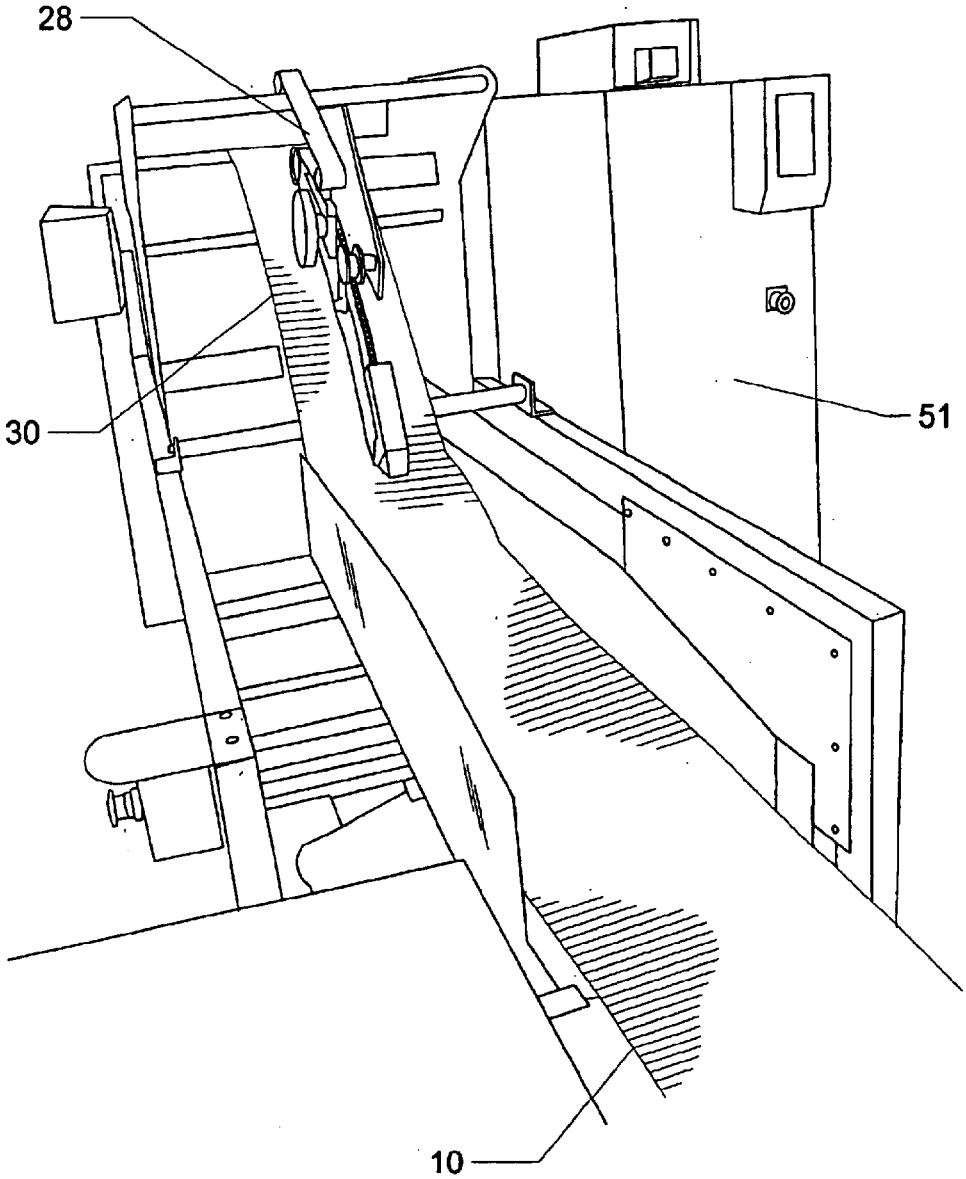
FIG. 3 illustrates a perspective view of a portion of an automatic case packaging machine.
Figure 4:
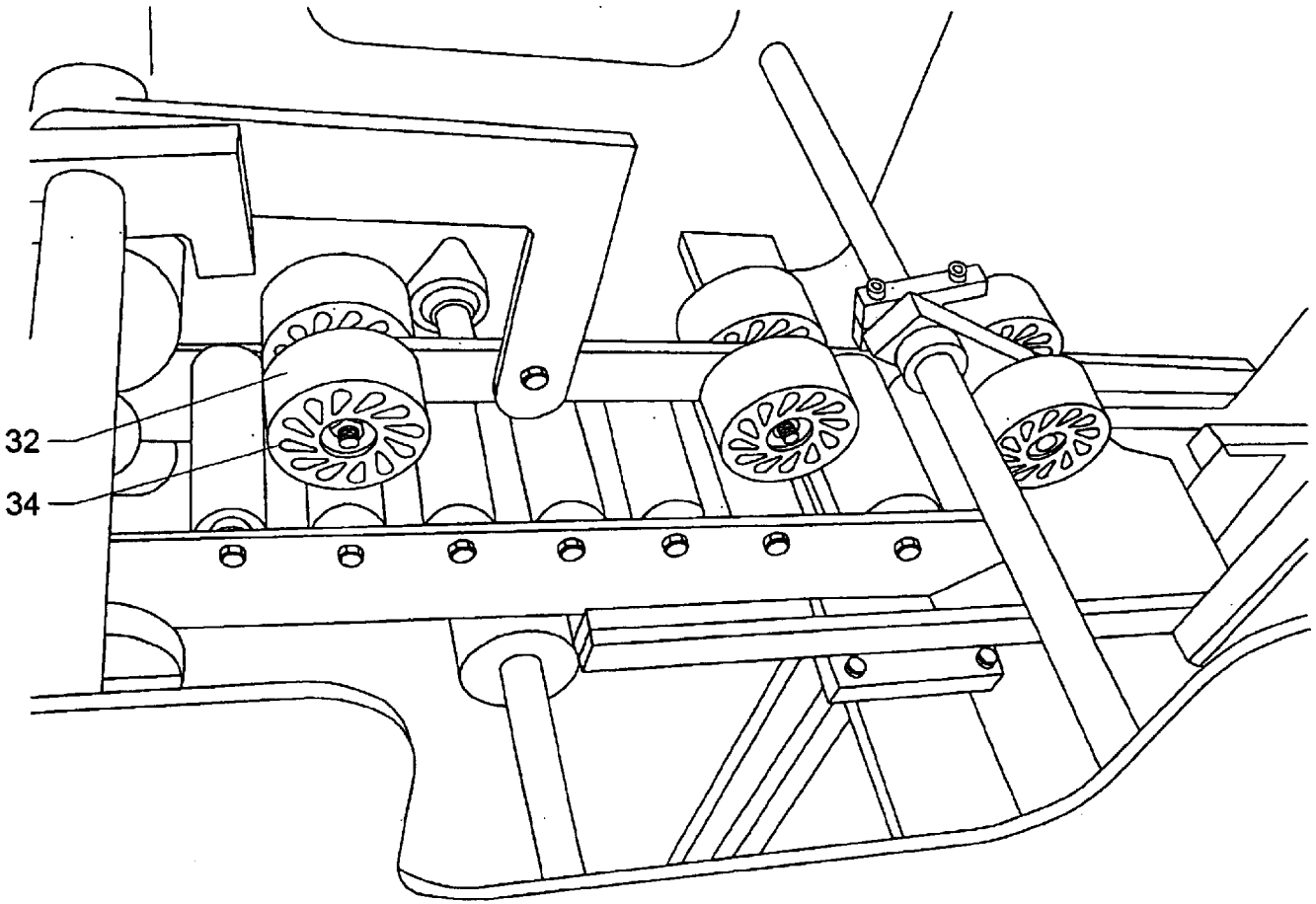
FIG. 4 illustrates a perspective view of another portion of the automatic case packaging machine of FIG. 3.

FIG. 3 illustrates a perspective of the in-feed mechanism of the auto packer machine 100. It shows the flat section 10 where cartons are placed and the arcuate (curved) conveyor 30 controlled by 1.5 inch incline belt 28 that conveys the cartons into a position for loading onto an elevator. At the top of the incline belt mechanism 28 are several sets of soft rollers 32 that are used to drive the cartons. In the embodiment shown in FIG. 4, there are three sets of soft rollers 32. The tear-shaped slots 34 on the sides of the soft rubber rollers 32 allow the rubber to compress. The tear-shaped slots are better illustrated in the perspective view of FIG. 5.

Figure 5:
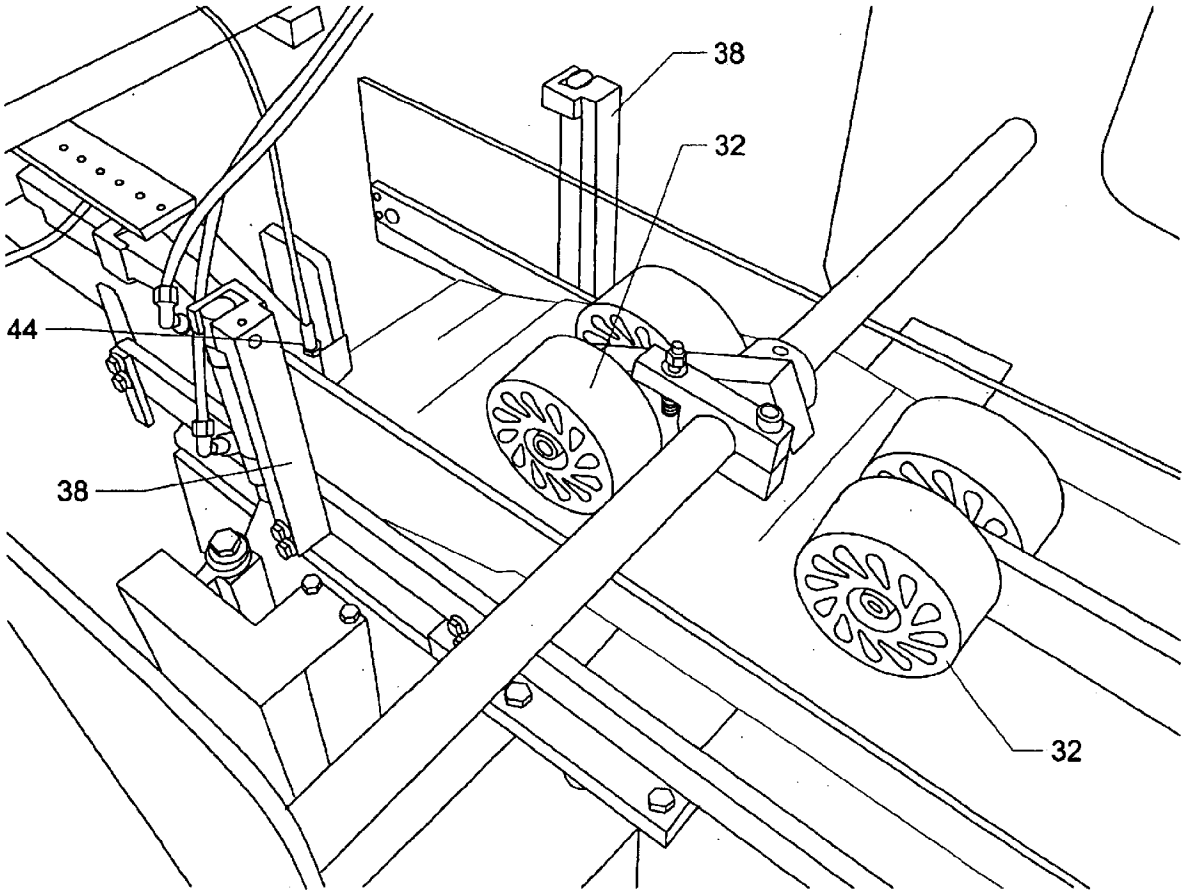
FIG. 5 illustrates a perspective view of still a further portion of the automatic case packaging machine of FIG. 3.

FIG. 5 illustrates a view of the top of the stacking assembly including a sensor switch 44 to control the cartons being fed into the elevator. The sensor switch 44 can be a photo sensor or an ultrasonic sensor to control the cartons as they are being fed from right to left into the elevator. Vertical air cylinders 38 control operation of (i.e., are actuators for) the surge gates. FIG. 5 illustrates the stacking of the articles to be loaded onto the elevator when the elevator is in a raised position. FIG. 7 illustrates a side view of the elevator as the elevator is being loaded with articles that are to be pushed by an air-powered ram into a case.

Figure 6:
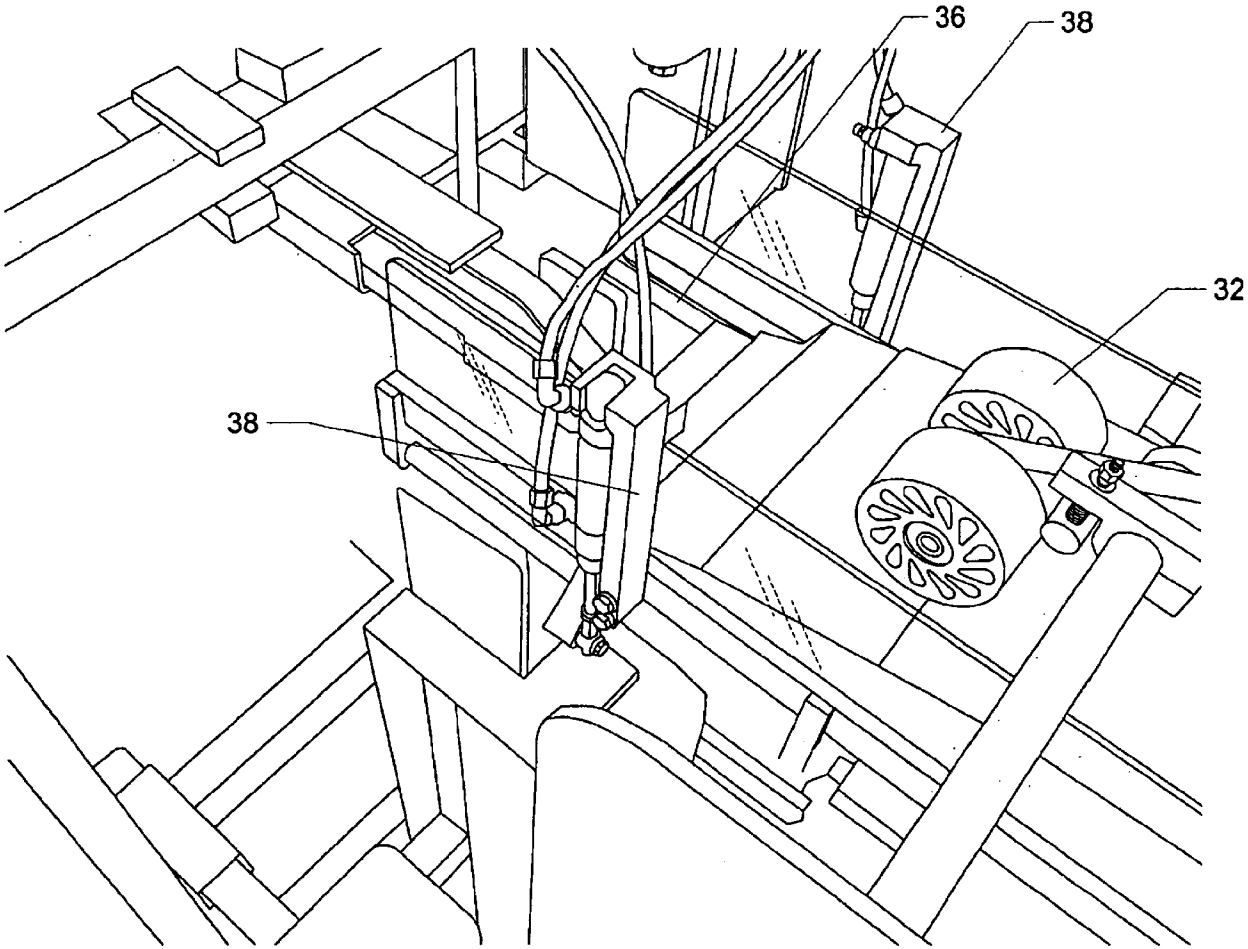
FIG. 6 illustrates a perspective view of yet another portion of the automatic case packaging machine of FIG. 3.

FIG. 6 illustrates a view of the surge gates in an exemplary embodiment of the invention. The surge gates 36 are horizontal plates that drop down and guide the cartons as the cartons fall into the elevator. There are identical surge gates 36 on both sides of the elevator. The surge gates 36 drop down and open up when the stack of cartons is dropped onto the elevator. The surge gates are kept in the horizontal position as the loaded elevator is emptied into the case positioned below. In the horizontal position, the surge gates keep the stack of cartons to be loaded into the next case under tension. When the elevator comes all the way back up to its top position, the surge gates 36 drop down and guide the cartons descend onto the elevator. No other surge gates function in this way to both tension a stack of cartons and guide the cartons onto an elevator.

The present invention uses a different type of surge gate than other case packaging apparatus. All other types of surge gates catch the stack of cartons and move the stack out horizontally. The surge gates 36 in the present invention catch the stack of cartons and move to become a guide for the stack. This prevents the first few cartons from being skewed in the elevator. Each surge gate 36 is controlled by an air cylinder 38.

FIG. 7 illustrates an out-feed side of the elevator with stack guides 52, 54 which are vertical plates that guide the stack of cartons as it is being loaded into the case.

Figure 8:
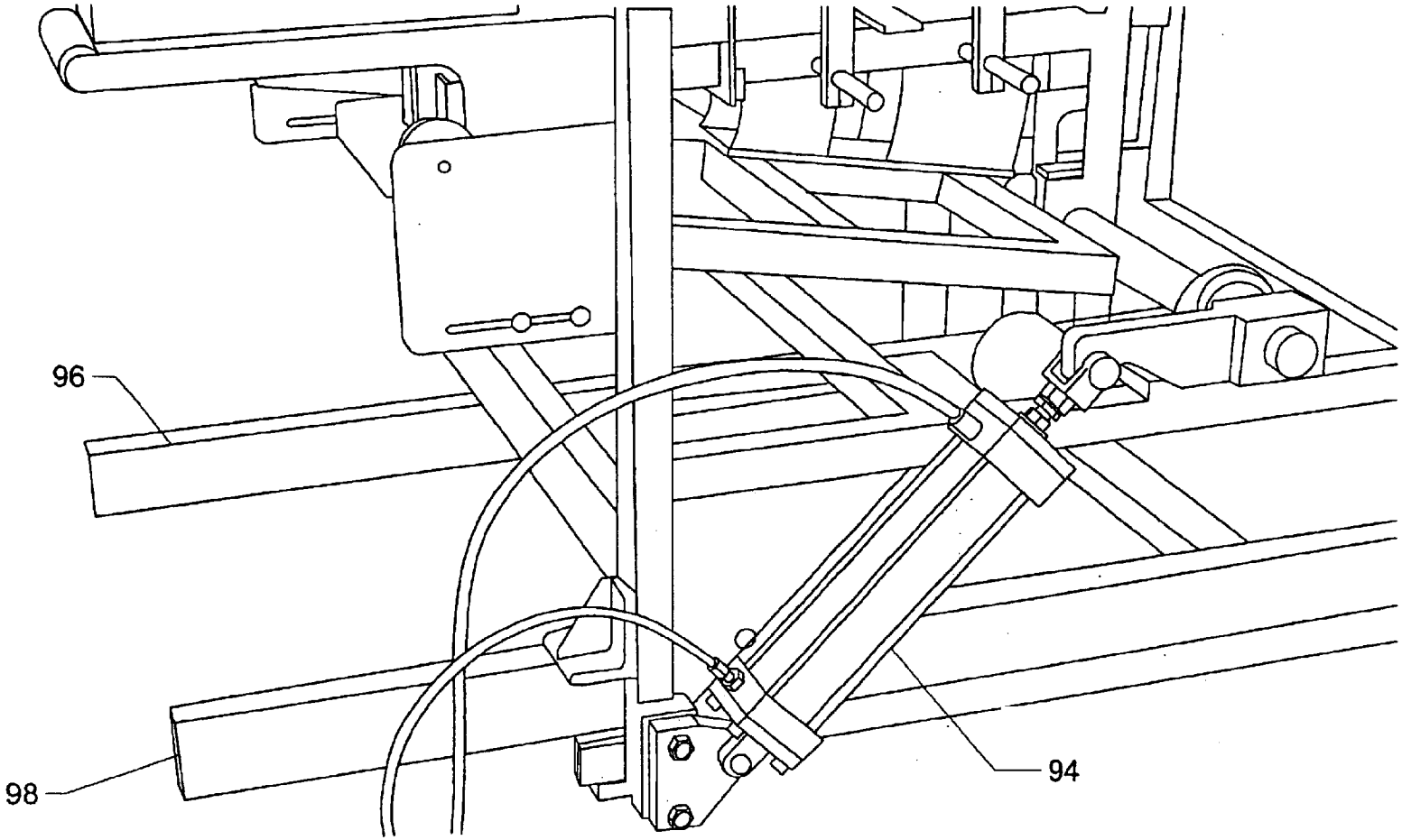
FIG. 8 illustrates another perspective view of a portion of the automatic case packaging machine of FIG. 3.

A counter weight 96 (shown in FIG. 10) on the case rack helps to make a smooth transfer of the full case before receiving an empty case. The case rack is controlled by an air cylinder. FIG. 8 illustrates the air cylinder 94 mounted to the outside of the auto packer chassis for operating the angled full case discharge. The air cylinder does not provide a smooth motion under a load. The air assist cylinder 94 also helps a case rack to move smoothly. It helps the main cylinder 94 to "take off". The counter weight 96 and air assist cylinder 94 are crucial to the smooth operation of the case rack.

Unlike other auto packers, the auto packer of the present invention does not use a floor to set the cartons on after filling. The elevator mechanism in this auto packer serves as a floor. Plastic, adjustable guides 49 allow the product to be leveled when filling the case. The photo eyes 47 allow the elevator to be set at the exact correct height to the case that is being filled.

The auto packer of the present invention uses an air powered side guide. The side guide is closed during the case filling process. When the stack is lowered to the case height to begin the motion to load the case, the guide opens to guide the cartons to the case. This prevents the cartons from hanging on the edge of the case. The top article guide is a set of rollers that keep the cartons from hanging on the top of the case as the articles are pushed into the case. This is the only auto packer to use a top carton guide.

Figure 9:
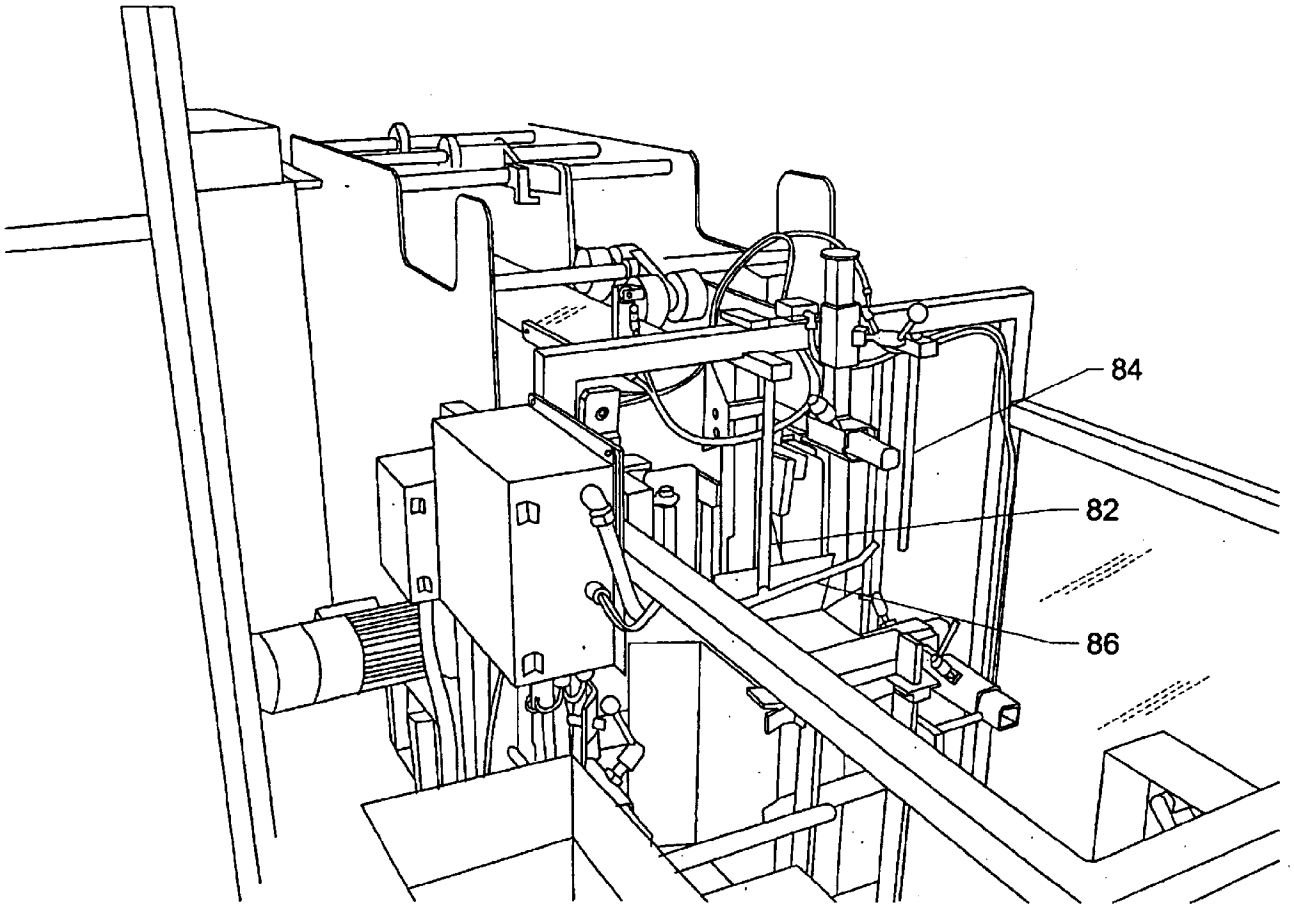
FIG. 9 illustrates a perspective view of another portion of the automatic case packaging machine of FIG. 3.

FIG. 9 illustrates a perspective view of the case flap guides that prevent the case flaps from impeding the loading of the case from the elevator. The case flap guides include vertical steel rods 82, 84 and horizontal steel rod 86. There is a slight bend in steel rod 86 going back into the auto packer machine. On other case packing machines, there is a problem with automating the filling of regular slotted (RSC) cases (i.e., slotted cases with flaps on top). The usual approach is to hang weights on the flaps to keep them out of the way. The case flap guides are also referred to as flap plows. When a case comes forward for loading, the flap guides plow the flaps out of the way.

A full case clamp is operated by a pancake air cylinder. It is used to clamp the full case when the case rack rotates the case to the discharge position. FIG. 10 shows rod 72 with clevis pin 74 attached on a bearing to the case rack. When the case is full, the rod pushes into a pancake air cylinder and the case rack rotates 90 degrees. An angled full case discharge is designed to allow the full case to roll off to the discharge belt. It is operated by air cylinders that force the rack up after a case has been filled. The air cylinders then compress to allow the case to load. FIG. 10 illustrates the angled set of rollers 88 that are used for unloading the filled case by ejecting the case at position 68 as shown in FIG. 2. The pancake air cylinder 92 is the air assist on full case pop-up feature. Pancake cylinders (actuators) are short-stroke, large-bore cylinders that fit in very tight spaces. The bore size and air pressure are directly related to the lift capacity of the cylinder. Two air pressure lines are connected to pancake cylinder 92. A first line is used to deliver air pressure to push the cylinder in one direction. The second line is used to deliver air pressure to push the cylinder to its original position. A side perspective view of the angled full case discharge mechanism with a case clamped in position for discharge is illustrated in FIG. 10. Also depicted is air assist pancake cylinder 92 showing the two pneumatic tubes for a double acting cylinder.

The auto packer uses a roller chassis to change the case size. The chassis is held in place by four set screws. This is the only auto packer that moves in this way. It is constructed of tubing with rollers on it, thereby allowing for smooth adjustment. FIG. 8 shows two frame elements 96, 98 extending outside the chassis and on which the discharge end of the case positioning mechanism can be rolled to adjust for different sizes of cases.

The corresponding structures, materials, acts, and equivalents of all means plus function elements in the claims below are intended to include any structure, material, or acts for performing the function in combination with other claim elements as specifically claimed.

Those skilled in the art will appreciate that many modifications to the exemplary embodiments of the present invention are possible without departing from the spirit and scope of the present invention.

What is claimed is:

1. A case packaging system for automatically stacking and loading a plurality of articles into a case, comprising:

an in-feed conveyor assembly including a flat portion for receiving the plurality of articles and an arcuate portion for delivering the articles on an inclined path of travel to a position where the articles are stacked;

an elevator mechanism for receiving the stacked articles;

a servomotor having a timing belt for raising the elevator to begin loading the stacked articles, and for lowering the elevator as the stacked articles continue to load onto the elevator, and a case positioning assembly for receiving a case to be filled, the case positioning assembly including a case rack assembly, a ram mechanism for moving the case onto the case rack adjacent the elevator, a clamp mechanism to clamp and rotate the case on the case rack to receive a stack of articles from the elevator, and a discharge mechanism to eject the case after the case has filled.

2. The case packaging system of claim 1 wherein the elevator mechanism comprises an adjustable floor.

3. The case packaging system of claim 2 wherein the elevator mechanism further comprises a plastic adjustable guide to keep the articles level as the articles load into the elevator.

4. The case packaging system of claim 1 further comprising a program logic controller including photo eyes to set the elevator at a correct height with respect to the case to be filled.

5. The case packaging system of claim 1 further comprising an additional servomotor to drive an in-feed belt adjacent the elevator mechanism.

6. The case packaging system of claim 1 farther comprising an additional servomotor to drive an out-feed belt adjacent the elevator mechanism.

7. The case packaging system of claim 1 further comprising a surge gate to catch the stack of articles at the top of the arcuate portion and to move to become a guide for the stack of articles as the articles move out horizontally onto the elevator.

8. The case packaging system of claim 7 further comprising an air cylinder to control the movement of each surge gate.

9. The case packaging system of claim 1 wherein the case rack further comprises a counterweight to provide a smooth transfer of the filled case before receiving a next case to be filled.

10. The case packaging system of claim 1 wherein the discharge mechanism comprises an air cylinder to control movement of the case rack and an air assist cylinder operating in conjunction with the air cylinder to provide a smooth motion of the case rack in ejecting a filled case.

11. The case packaging system of claim 1 further comprising a pancake air cylinder to operate the clamping mechanism when the discharge mechanism rotates the case to a discharge position.

12. The case packaging system of claim 1 wherein the discharge mechanism comprises a plurality of angled rollers to eject the filled case after the case is rotated into the upright position.

13. The case packaging system of claim 1 further comprising a top article guide aligned adjacent a case positioned on the elevator mechanism.

14. The case packaging system of claim 13 wherein the top article guide comprises a set of rollers.

15. The case packaging system of claim 1 further comprising an air-powered side guide that opens during the filling of the case to guide the articles into the case.

16. The case packaging system of claim 1 further comprising a flap guide to restrain a plurality of flaps of the case as the case is being filled.

17. The case packaging system of claim 16 wherein each flap guide comprises a plurality of connected rods.

18. The case packaging system of claim 1 further comprising a roller chassis to enable adjustment of a case size for loading of articles.

19. The case packaging system of claim 1 wherein the roller chassis comprises a plurality of frame elements on which the discharge mechanism can be rolled to adjust for a different case size.

20. The case packaging system of claim 19 wherein the frame elements comprise tubing with rollers to enable a smooth adjustment of the position of the discharge mechanism.

* * * * *

UNITED STATES PATENT AND TRADEMARK OFFICE

CERTIFICATE OF CORRECTION

PATENT NO. : 6,952,911 B2
DATED : October 11, 2005
INVENTOR(S) : Byrd, Jr. et al.

It is certified that error appears in the above-identified patent and that said Letters Patent is hereby corrected as shown below:

Column 5,
Line 48, “farther” should be changed to -- further --.

Drawings,
FIG. 1, numeral “43” should be changed to -- 49 --.
FIG. 1, numeral “44” should be changed to -- 41 --.
FIG. 8, numeral “96” should be changed to -- 97 --.
FIG. 10, numeral “72” that points to a rod and is adjacent numeral “74” should be changed to -- 73 --.

Column 2,
Line 54, add -- (shown in FIG. 6) -- after numeral “36”.
Line 67, delete numeral “40”.

Column 3,
Line 10, numeral “44” should be changed to -- 41 --.

Column 4,
Line 5, numeral “94” should be changed to -- 92 --.
Line 8, numeral “94” should be changed to -- 92 --.
Line 41, numeral “72” should be changed to -- 73 --.
Lines 60-61, delete “with a case damped in position for discharge”.
Lines 61-63, delete the sentence beginning with “Also depicted” and ending with “double acting cylinder” and insert -- Air cylinder 94 showing two pneumatic tubes for a double acting cylinder is depicted in FIG. 8. --.

UNITED STATES PATENT AND TRADEMARK OFFICE

CERTIFICATE OF CORRECTION

PATENT NO. : 6,952,911 B2
DATED : October 11, 2005
INVENTOR(S) : Byrd, Jr. et al.

It is certified that error appears in the above-identified patent and that said Letters Patent is hereby corrected as shown below:

Column 5,
Line 1, numeral "96" should be changed to -- 97 --.

Signed and Sealed this

Sixteenth Day of May, 2006

JON W. DUDAS
*Director of the United States Patent and Trademark Office*